US012059038B2

(12) United States Patent
Jung

(10) Patent No.: US 12,059,038 B2
(45) Date of Patent: Aug. 13, 2024

(54) AEROSOL GENERATING DEVICE AND OPERATION METHOD THEREOF

(71) Applicant: KT&G CORPORATION, Daejeon (KR)

(72) Inventor: Hyung Jin Jung, Seoul (KR)

(73) Assignee: KT&G CORPORATION, Daejeon (KR)

( * ) Notice: Subject to any disclaimer, the term of this patent is extended or adjusted under 35 U.S.C. 154(b) by 603 days.

(21) Appl. No.: 17/291,666

(22) PCT Filed: Dec. 9, 2020

(86) PCT No.: PCT/KR2020/017967
§ 371 (c)(1),
(2) Date: May 6, 2021

(87) PCT Pub. No.: WO2021/157836
PCT Pub. Date: Aug. 12, 2021

(65) Prior Publication Data

US 2022/0361582 A1 Nov. 17, 2022

(30) Foreign Application Priority Data

Feb. 7, 2020 (KR) ..... 10-2020-0015173

(51) Int. Cl.
*A24F 40/51* (2020.01)
*A24F 40/40* (2020.01)

(52) U.S. Cl.
CPC ..... *A24F 40/51* (2020.01); *A24F 40/40* (2020.01)

(58) Field of Classification Search
CPC ..... A24F 40/51; A24F 40/40; A24F 40/20; A24F 40/30; A24F 40/50; A24F 40/10; A24F 40/46; A24F 40/57
See application file for complete search history.

(56) References Cited

U.S. PATENT DOCUMENTS

| | | | | |
|---|---|---|---|---|
| 5,902,501 | A | 5/1999 | Nunnally et al. | |
| 10,159,283 | B2 | 12/2018 | Mironov | |
| 10,527,747 | B2 | 1/2020 | Wazumi et al. | |
| 11,817,675 | B1 * | 11/2023 | Raring | H04N 9/77 |
| 2006/0196518 | A1 * | 9/2006 | Hon | A24B 15/167 131/347 |

(Continued)

FOREIGN PATENT DOCUMENTS

| | | | |
|---|---|---|---|
| EP | 3 406 148 | A1 | 11/2018 |
| JP | 2017-515488 | A | 6/2017 |

(Continued)

OTHER PUBLICATIONS

Korean Office Action dated Mar. 3, 2023 in Korean Application No. 10-2021-0116508.

(Continued)

*Primary Examiner* — Truc T Nguyen
(74) *Attorney, Agent, or Firm* — Sughrue Mion, PLLC

(57) ABSTRACT

An aerosol generating device that is configured to determine an insertion and a separation of an aerosol generating substance from the aerosol generating device based on an amount of change in inductance and control a heater to heat the aerosol generating substance based on a result of the determination.

15 Claims, 8 Drawing Sheets

(56) References Cited

U.S. PATENT DOCUMENTS

| | | | | |
|---|---|---|---|---|
| 2015/0245666 | A1* | 9/2015 | Memari | A24F 40/60 131/329 |
| 2016/0021930 | A1* | 1/2016 | Minskoff | A24F 40/51 392/395 |
| 2017/0042237 | A1 | 2/2017 | Murison et al. | |
| 2017/0095003 | A1 | 4/2017 | Mironov | |
| 2017/0127722 | A1* | 5/2017 | Davis | A24F 40/95 |
| 2017/0135404 | A1 | 5/2017 | Reevell | |
| 2019/0313695 | A1 | 10/2019 | Kaufman et al. | |
| 2019/0313698 | A1 | 10/2019 | Kuczaj | |
| 2020/0000146 | A1* | 1/2020 | Anderson | H01R 13/6205 |
| 2020/0093185 | A1 | 3/2020 | Lim | |
| 2020/0221775 | A1* | 7/2020 | Mironov | A24F 40/465 |
| 2021/0007393 | A1 | 1/2021 | Jung et al. | |
| 2021/0076736 | A1 | 3/2021 | Fernando et al. | |
| 2022/0000178 | A1* | 1/2022 | Crump | A24F 40/465 |
| 2022/0087309 | A1 | 3/2022 | Han et al. | |
| 2022/0183389 | A1* | 6/2022 | Carmichael | A24F 40/60 |
| 2022/0312849 | A1* | 10/2022 | Jackson | A24F 40/20 |
| 2022/0361582 | A1* | 11/2022 | Jung | A24F 40/40 |
| 2022/0366749 | A1* | 11/2022 | Mukherjee | E05B 47/0002 |
| 2022/0408805 | A1* | 12/2022 | Benning | A24F 40/46 |

FOREIGN PATENT DOCUMENTS

| | | | | |
|---|---|---|---|---|
| JP | 2018-152320 | A | 9/2018 | |
| JP | 2019-205405 | A | 12/2019 | |
| KR | 10-0579783 | B1 | 5/2006 | |
| KR | 10-2015-0097820 | A | 8/2015 | |
| KR | 10-2017-0007262 | A | 1/2017 | |
| KR | 10-1776966 | B1 | 9/2017 | |
| KR | 10-2018-0111460 | A | 10/2018 | |
| KR | 10-2018-0129637 | A | 12/2018 | |
| KR | 10-2020-0005082 | A | 1/2020 | |
| KR | WO 2021246646 | * | 12/2021 | A24F 40/465 |
| WO | 99/20940 | A1 | 4/1999 | |
| WO | 2018/216961 | A1 | 11/2018 | |
| WO | 2019/197170 | A1 | 10/2019 | |
| WO | 2020/105896 | A1 | 5/2020 | |

OTHER PUBLICATIONS

Communication dated Aug. 5, 2022 from the Canadian Intellectual Property Office in Application No. 3,117,188.

Communication dated Sep. 20, 2022 from the Japanese Patent Office in Application No. 2021-540802.

International Search Report for PCT/KR2020/017967 dated Mar. 22, 2021 (PCT/ISA/210).

Written Opinion of the International Searching Authority for PCT/KR2020/017967 dated Mar. 22, 2021 (PCT/ISA/237).

Extended European Search Report dated Nov. 2, 2021 in European Application No. 20883280.8.

* cited by examiner

[Fig. 1]
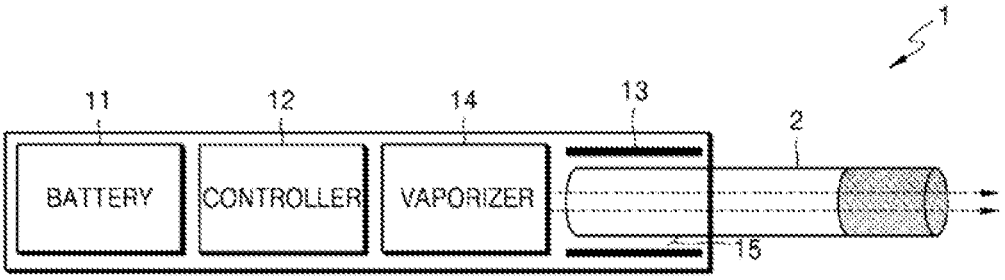
[Fig. 2]
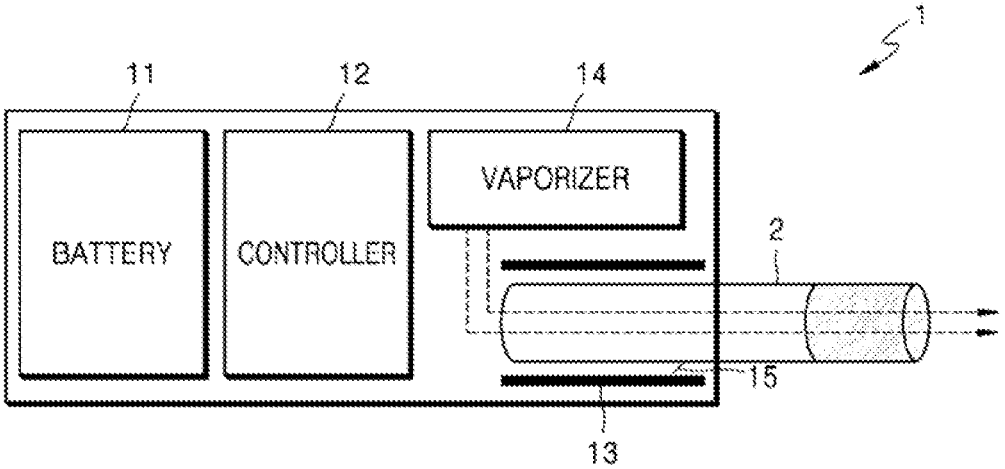
[Fig. 3]
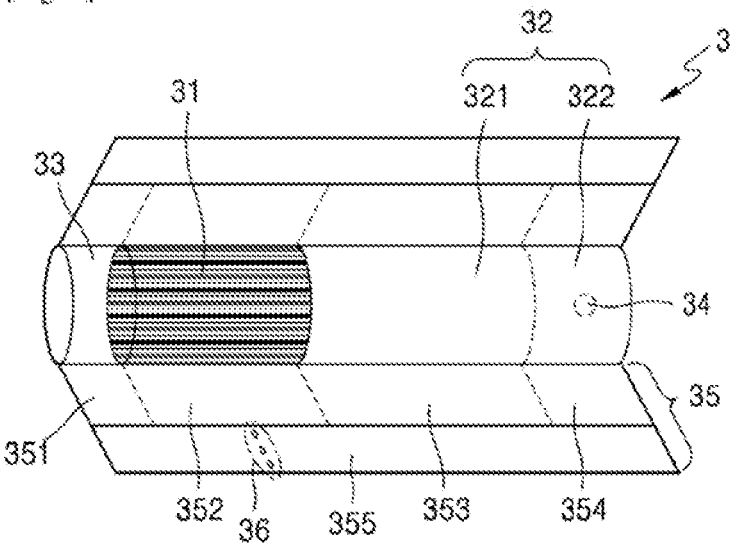

[Fig. 4]
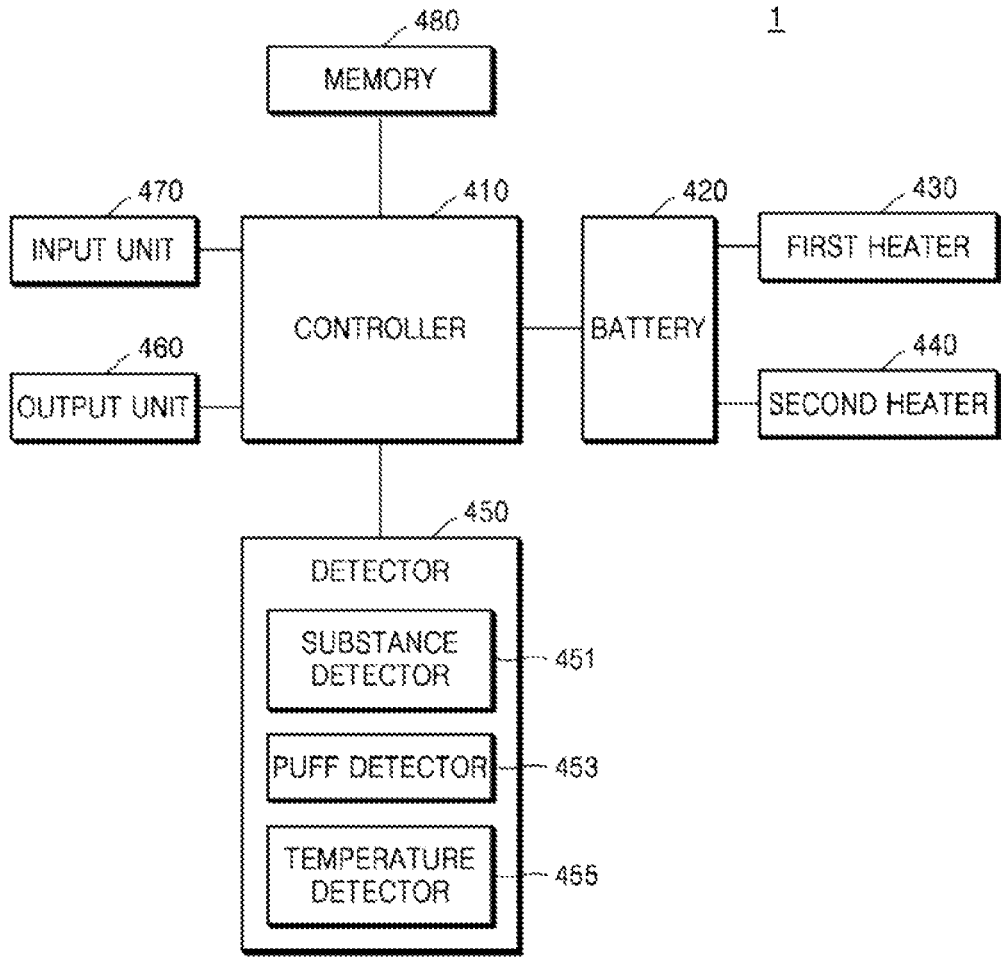

[Fig. 5]
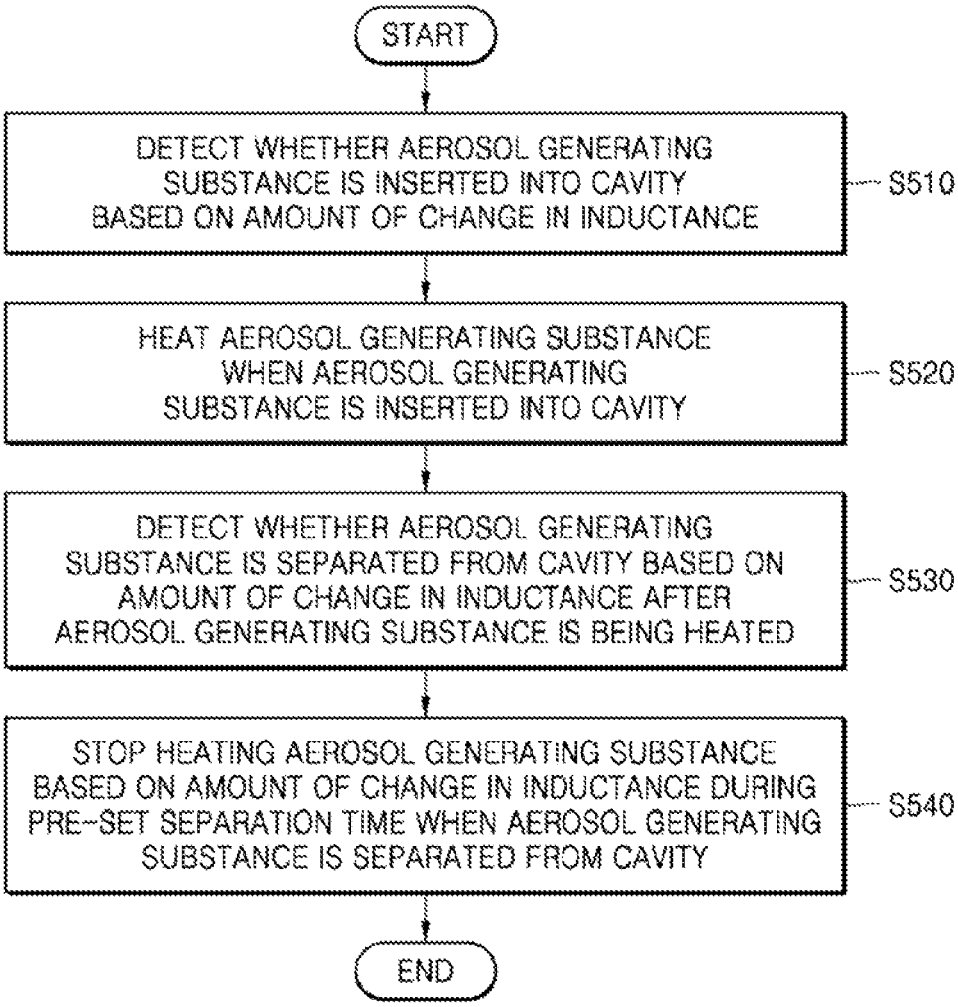

[Fig. 6]
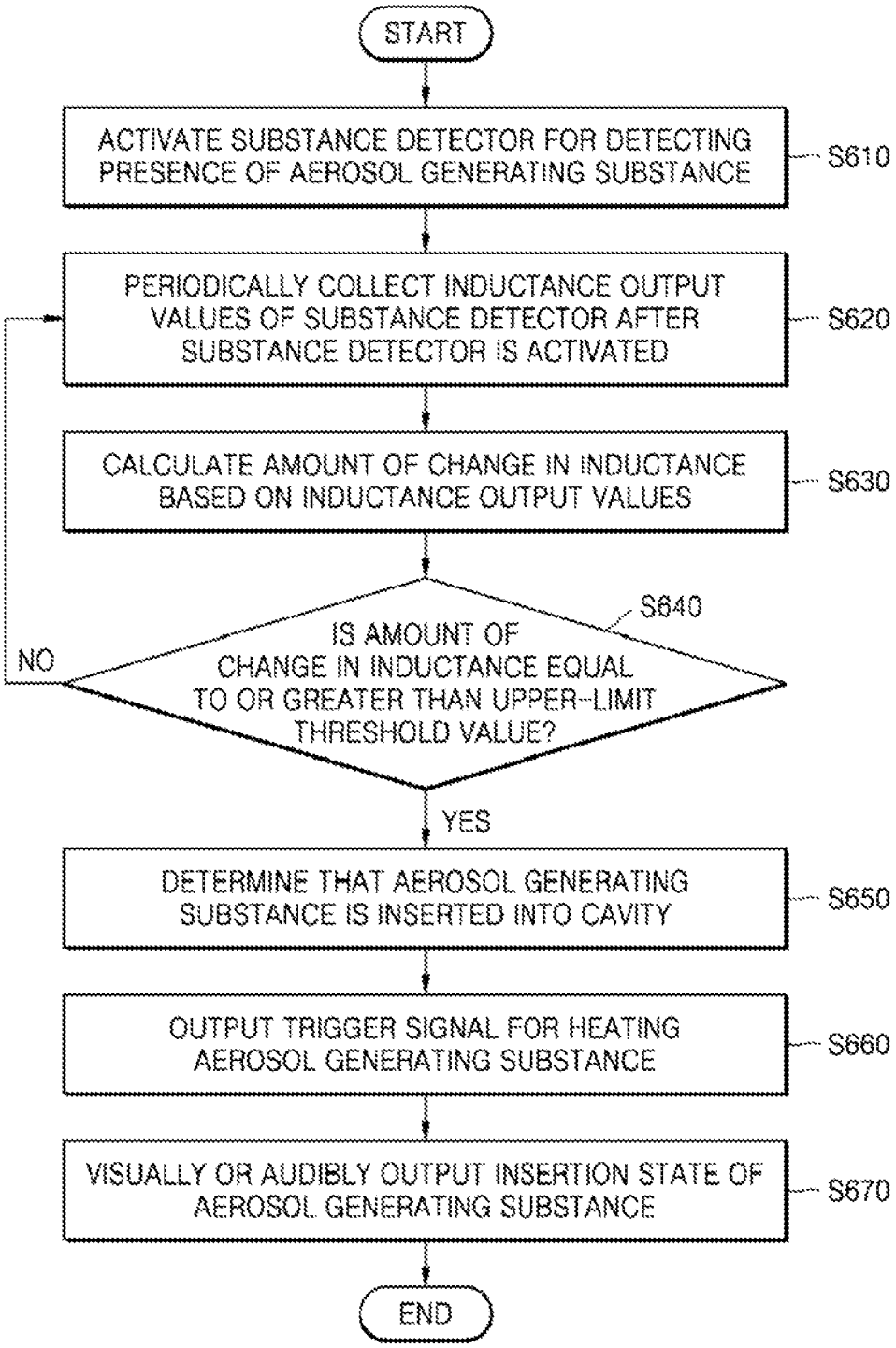

[Fig. 7]
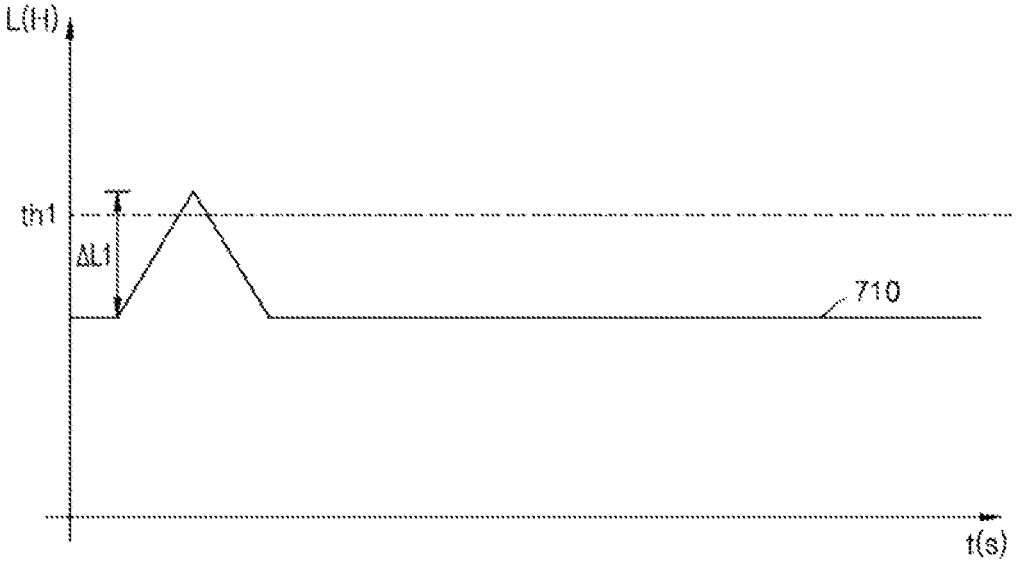
[Fig. 8]
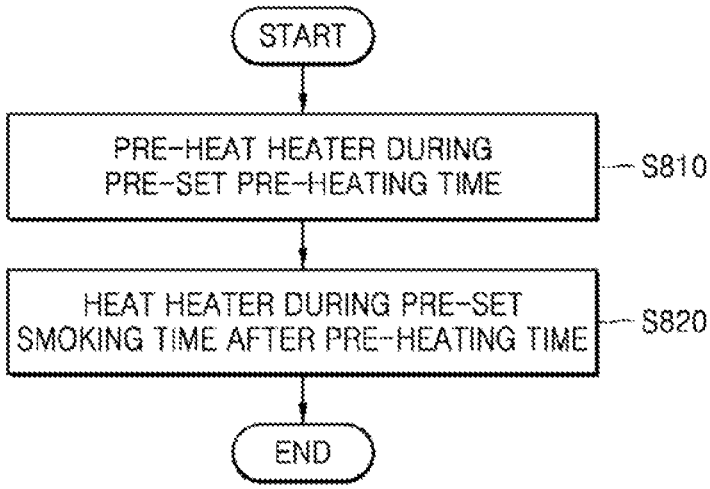
[Fig. 9]
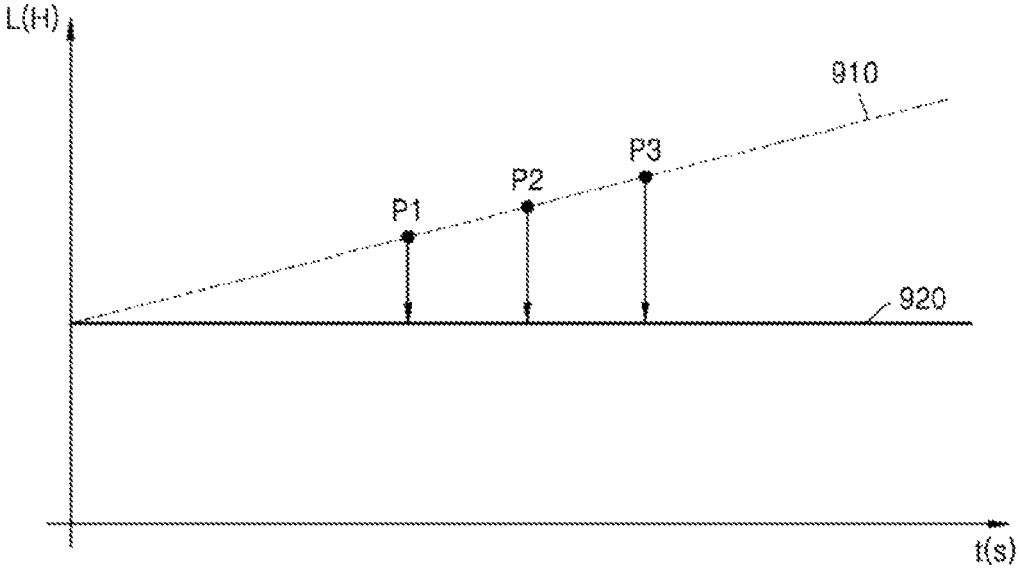

[Fig. 10]
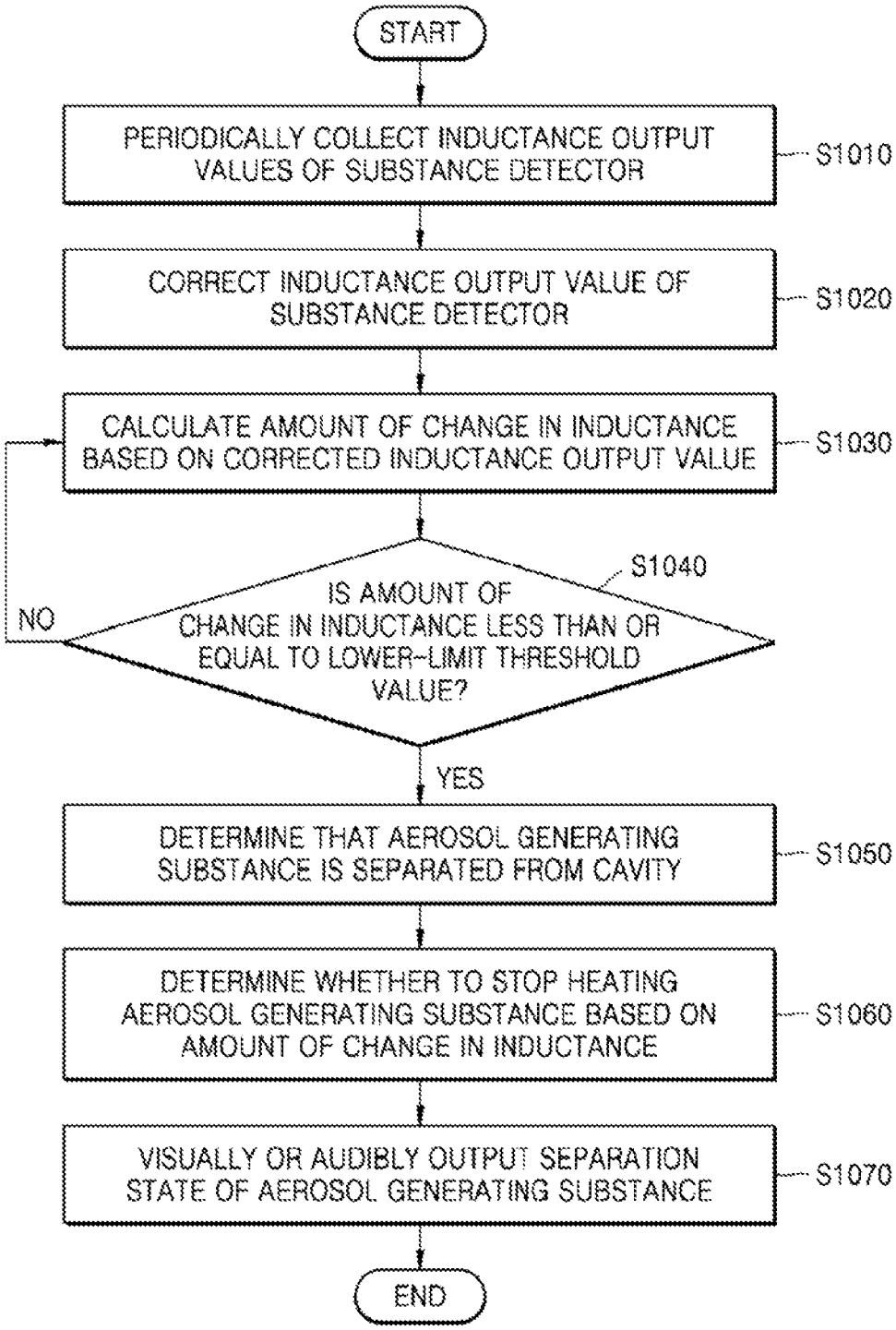

[Fig. 11]
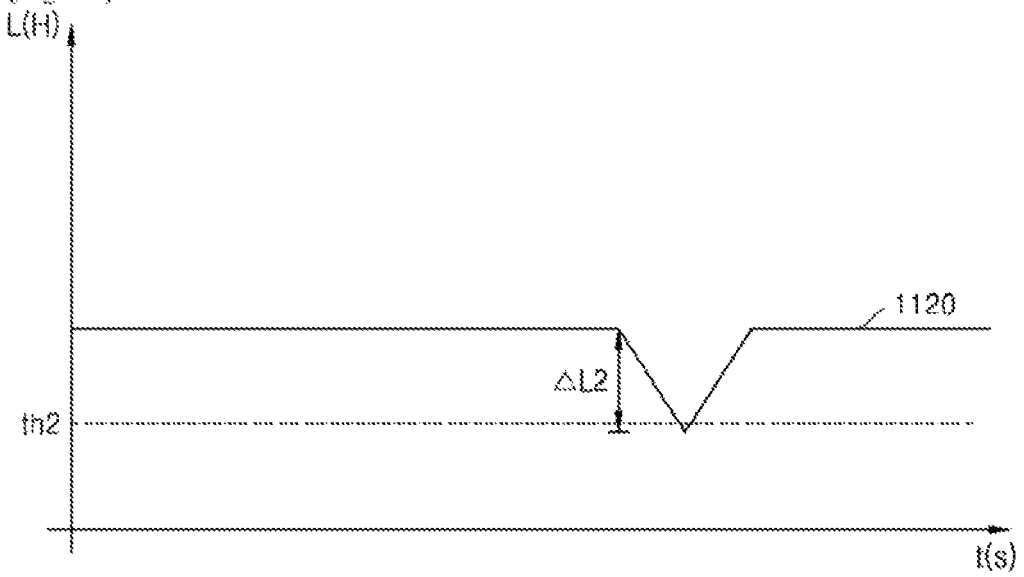

[Fig. 12]
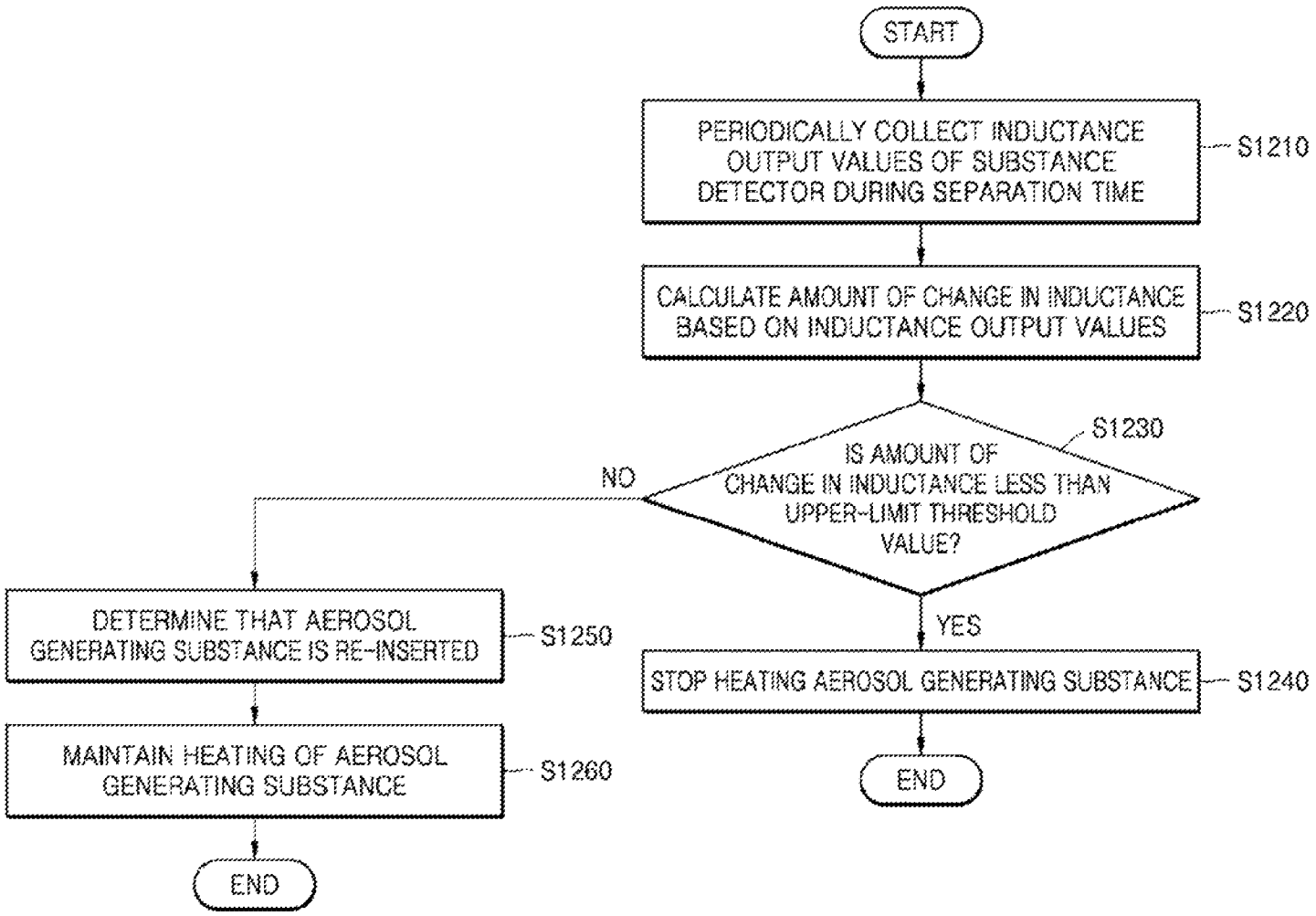

AEROSOL GENERATING DEVICE AND OPERATION METHOD THEREOF

TECHNICAL FIELD

The disclosure relates to an aerosol generating device and an operation method thereof, and more particularly, to an aerosol generating device capable of automatically heating a heater by recognizing an aerosol generating substance, and an operation method thereof.

BACKGROUND ART

Recently, there is a growing demand for alternative methods of resolving problems of common cigarettes. For example, there is an increasing demand for a method of generating aerosols by heating an aerosol generating material in cigarettes or liquid storages rather than by burning cigarettes.

However, in a conventional aerosol generating device, an additional input operation by a user is required to heat a heater after a cigarette is inserted, thereby causing inconvenience to the user and a delay until a first puff.

DISCLOSURE OF INVENTION

Technical Problem

One or more embodiments include an aerosol generating device capable of recognizing insertion of a cigarette and automatically heating a heater and an operation method thereof.

One or more embodiments include an aerosol generating device capable of recognizing separation of a cigarette from the aerosol generating device and automatically stopping heating of a heater and an operation method thereof.

The technical problems of the present disclosure are not limited to the above-description, and other technical problems may be solved from the embodiments described hereinafter.

Solution to Problem

According to one or more embodiments, an operation method of an aerosol generating device, the method includes detecting whether an aerosol generating substance is inserted into a cavity based on an amount of change in inductance; heating the aerosol generating substance based on the aerosol generating substance being inserted into the cavity; detecting whether the aerosol generating substance is separated from the cavity based on the amount of change in the inductance while the aerosol generating substance is being heated; and, stopping the heating of the aerosol generating substance based on the amount of change in the inductance during a pre-set separation time when the aerosol generating substance is separated from the cavity.

Advantageous Effects of Invention

An aerosol generating device and an operation method thereof according to one or more embodiments may improve user convenience by automatically heating a heater without an additional user input after a cigarette is recognized.

Also, the aerosol generating device and the operation method thereof may reduce a delay until a first puff of a user by automatically heating a heater after a cigarette is recognized.

Also, the aerosol generating device and the operation method thereof automatically stop heating a heater by recognizing separation of a cigarette, thereby preventing overheating of the aerosol generating device and reducing power consumption.

The advantages and effects according to the above-described embodiments are not limited thereto, and may include other advantages and effects that may be understood by one of ordinary skill in the art from the present disclosure.

BRIEF DESCRIPTION OF DRAWINGS

FIGS. 1 and 2 are diagrams showing examples in which a cigarette is inserted into an aerosol generating device.

FIG. 3 is a diagram showing an example of the cigarette shown in FIGS. 1 and 2.

FIG. 4 is a block diagram of an aerosol generating device according to one or more embodiments.

FIG. 5 is a flowchart for describing a method of operation of a heater based on whether an aerosol generating substance is inserted and separated, according to one or more embodiments.

FIG. 6 is a flowchart for describing a method of detecting an insertion of an aerosol generating substance and corresponding operations of a heater and an output unit when an aerosol generating substance is inserted.

FIG. 7 is a graph further describing FIG. 6.

FIG. 8 is a flowchart of a method of heating a heater according to a pre-heating period and a smoking period.

FIG. 9 is a graph showing a change in an inductance output value according to an increase in temperature of a heater.

FIG. 10 is a flowchart for describing a method of detecting a separation of an aerosol generating substance and corresponding operations of a heater and an output unit when an aerosol generating substance is separated.

FIG. 11 is a graph further describing FIG. 10.

FIG. 12 is a flowchart of a method of stopping heating of a heater when an aerosol generating substance is separated.

BEST MODE FOR CARRYING OUT THE INVENTION

According to one or more embodiments, an operation method of an aerosol generating device, the method includes detecting whether an aerosol generating substance is inserted into a cavity based on an amount of change in inductance; heating the aerosol generating substance based on the aerosol generating substance being inserted into the cavity; detecting whether the aerosol generating substance is separated from the cavity based on the amount of change in the inductance while the aerosol generating substance is being heated; and based on determining that the aerosol generating substance is separated from the cavity, stopping the heating of the aerosol generating substance based on the amount of change in the inductance during a pre-set separation time.

Also, the detecting of whether the aerosol generating substance is inserted into the cavity may include activating a substance detector configured to detect a presence of the aerosol generating substance; periodically collecting inductance output values of the substance detector after the substance detector is activated; calculating the amount of change in the inductance based on the inductance output values; and determining that the aerosol generating substance is inserted into the cavity based on the amount of change in the inductance being equal to or greater than a pre-set upper-limit threshold value.

Also, the detecting of whether the aerosol generating substance is inserted into the cavity may further include, outputting a trigger signal for heating the aerosol generating substance based on determining that the aerosol generating substance is inserted into the cavity.

Also, the detecting of whether the aerosol generating substance is inserted into the cavity may further include visually or audibly outputting an insertion state of the aerosol generating substance.

Also, the heating of the aerosol generating substance may include pre-heating a heater for heating the aerosol generating substance during a pre-set pre-heating time; and heating the heater during a pre-set smoking time after the pre-set pre-heating time.

Also, the pre-heating of the heater may include initiating pre-heating of the heater based on a trigger signal generated by an insertion of the aerosol generating substance; and increasing a temperature of the heater to a vaporization temperature at which aerosol is generated.

Also, in the heating of the heater, the temperature of the heater may be maintained equal to or above the vaporization temperature during the smoking time.

Also, the detecting of whether the aerosol generating substance is separated from the cavity may include correcting an inductance output value of a substance detector configured to detect a presence of the aerosol generating substance; calculating the amount of change in the inductance based on a corrected inductance output value; and determining that the aerosol generating substance is separated from the cavity based on the amount of change in the inductance being less than or equal to a pre-set lower-limit threshold value.

Also, the correcting of the inductance output value includes decreasing the inductance output value of the substance detector in response to an increase in a temperature of a heater configured to heat the aerosol generating substance.

Also, the detecting of whether the aerosol generating substance is separated from the cavity may further include visually or audibly outputting a separation state of the aerosol generating substance.

Also, the stopping of the heating of the aerosol generating substance may include periodically collecting inductance output values of the substance detector during the preset separation time; calculating the amount of change in the inductance based on the inductance output values; and, stopping heating of the aerosol generating substance based on the amount of change in the inductance being less than a pre-set upper-limit threshold value.

According to one or more embodiments, an aerosol generating device includes a cavity configured to receive an aerosol generating substance; a heater configured to heat the aerosol generating substance in the cavity; a substance detector configured to measure an inductance that varies according to an insertion and a separation of the aerosol generating substance; a battery configured to supply power to the heater and the substance detector; and a controller configured to determine the insertion and the separation of the aerosol generating substance based on an amount of change in the inductance and control the heater to heat the aerosol generating substance based on a result of the determination.

Also, the controller may be further configured to activate the substance detector while the power is not supplied to the heater, periodically collect inductance output values of the substance detector, calculate the amount of change in the inductance based on the inductance output values, and determine that the aerosol generating substance is inserted into the cavity based on the amount of change in the inductance being equal to or greater than a pre-set upper-limit threshold value.

Also, the controller may be further configured to output a trigger signal for heating the aerosol generating substance based on determining that the aerosol generating substance is inserted into the cavity.

Also, a pre-heating of the heater may be initiated by the trigger signal, and the controller may be further configured to increase a temperature of the heater to a vaporization temperature at which aerosol is generated by pre-heating the heater during a pre-set pre-heating time.

Also, the controller may maintain the temperature of the heater equal to or above the vaporization temperature during a pre-set smoking time after the pre-heating time.

Also, the controller may be further configured to correct the inductance output value of the substance detector while the heater is being heated, calculate the amount of change in the inductance based on the corrected inductance output value, and determine that the aerosol generating substance is separated from the cavity based on the amount of change in the inductance being less than or equal to a pre-set lower-limit threshold value.

Also, the controller may be further configured to correct the inductance output value by decreasing the inductance output value of the substance detector in response to an increase in the temperature of the heater.

Also, the controller may be further configured to, periodically collect the inductance output values of the substance detector during a pre-set separation time based on determining that the aerosol generating substance is separated from the cavity, calculate the amount of change in the inductance based on the inductance output values, and, stop heating of the aerosol generating substance based on the amount of change in the inductance being less than a pre-set upper-limit threshold value.

Also, the aerosol generating device may further include an output unit configured to visually or audibly output an insertion state and a separation state of the aerosol generating substance.

MODE FOR THE INVENTION

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above." "directly on," "directly connected to" or "directly coupled to" another element or layer, there are no intervening elements or layers present. Like numerals refer to like elements throughout.

With respect to the terms in the various embodiments of the present disclosure, the general terms which are currently and widely used are selected in consideration of functions of structural elements in the various embodiments of the present disclosure. However, meanings of the terms may be changed according to intentions of one of ordinary skill in the art, a judicial precedent, an emergence of a new technology, and the like. In addition, in certain cases, there is also a term arbitrarily selected, in which case the meaning will be described in detail in the description of one or more embodiments. Therefore, the terms used in one or more embodiments should be defined based on the meanings of the terms and the context of the disclosure.

In addition, unless explicitly indicated otherwise, the word "comprise" and variations such as "comprises" or "comprising" will be understood to imply the inclusion of stated elements but not the exclusion of any other elements. In addition, the terms "-er", "-or", and "module" may mean units for processing at least one function and operation and can be implemented by hardware components or software components and/or a combinations thereof.

In the disclosure, "puff" may refer to an inhalation of certain aerosol by a user, and the inhalation may refer to an act of breathing in by a user through the user's mouth, nasal cavity, or lung.

In the disclosure, a pre-heating period refers to a period for increasing respective temperatures of a first heater and a second heater, and a smoking period may refer to a period for maintaining the temperature of the first heater and a period during which a user inhales aerosol. Hereinafter, a pre-heating period and a smoking period may have the same meaning as a pre-heating time and a smoking time, respectively.

Hereinafter, the present disclosure will be described in more detail with reference to the accompanying drawings, in which exemplary embodiments of the present disclosure are described such that one of ordinary skill in the art may understand and practice the one or more embodiments of the present disclosure. The inventive concept may, however, be embodied in many different forms and should not be construed as being limited to the embodiments set forth herein.

Hereinafter, one or more embodiments of the inventive concept will be described in detail with reference to the drawings. 1511 FIGS. 1 and 2 are diagrams showing examples in which a cigarette is inserted into an aerosol generating device.

Referring to FIGS. 1 and 2, the aerosol generating device 1 may include a battery 11, a controller 12, a heater 13 and vaporizer 14. Also, the cigarette 2 may be inserted into an inner space of the aerosol generating device 1.

FIGS. 1 and 2 illustrate certain components of the aerosol generating device 1. It will be understood by one of ordinary skill in the art related to the present embodiment that other components may be further included in the aerosol generating device 1, in addition to the components illustrated in FIGS. 1 and 2.

FIG. 1 illustrates that the battery 11, the controller 12, the heater 13, and vaporizer 14 are arranged in series. In addition, FIG. 2 illustrates that the vaporizer 14 and the heater 13 are arranged in parallel. However, the internal structure of the aerosol generating device 1 is not limited to the structures illustrated in FIGS. 1 and 2. In other words, according to the design of the aerosol generating device 1, the battery 11, the controller 12, the heater 13, and the vaporizer 14 may be arranged differently.

When the cigarette 2 is inserted into a cavity 15 of the aerosol generating device 1, the aerosol generating device 1 may operate the heater 13 and/or the vaporizer 14 to generate an aerosol. The aerosol generated by the heater 13 and/or the vaporizer 14 is delivered to a user by passing through the cigarette 2.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. included in the aerosol generating device 1.

The controller 12 may control overall operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is in an operable state.

The controller 12 may include at least one processor. A processor can be implemented as an array of a plurality of logic gates or can be implemented as a combination of a microprocessor and a memory in which a program executable by the microprocessor is stored. It will be understood by one of ordinary skill in the art that one or more processors can be implemented in other forms of hardware.

The heater 13 may be heated by the power supplied from the battery 11. For example, when the cigarette 2 is inserted into the aerosol generating device 1, the heater 13 may be located outside the cigarette 2. Thus, the heated heater 13 may increase a temperature of an aerosol generating material in the cigarette 2.

The heater 13 may include an electro-resistive heater. For example, the heater 13 may include an electrically conductive track, and the heater 13 may be heated when currents flow through the electrically conductive track. However, the heater 13 is not limited to the example described above and may include any heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette in an induction heating method, and the cigarette may include a susceptor which may be heated by the induction heater.

For example, the heater 13 may include a tube-type heating element, a plate-type heating element, a needle-type heating element, or a rod-type heating element, and may heat the inside or the outside of the cigarette 2, according to the shape of the heating element.

Also, the aerosol generating device 1 may include a plurality of heaters 13. Here, the plurality of heaters 13 may be inserted into the cigarette 2 or may be arranged outside the cigarette 2. Also, some of the plurality of heaters 13 may be inserted into the cigarette 2 and the others may be arranged outside the cigarette 2. In addition, the shape of the heater 13 is not limited to the shapes illustrated in FIGS. 1 through 3 and may include various shapes.

The vaporizer 14 may generate an aerosol by heating a liquid composition and the generated aerosol may pass through the cigarette 2 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 2 and delivered to the user.

For example, the vaporizer 14 may include a liquid storage, a liquid delivery element, and a heating element, hut it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be attached to/detached from the vaporizer 14 or may be formed integrally with the vaporizer 14.

For example, the liquid composition may include water, a solvent, ethanol, plant extract, spices, flavors, or a vitamin mixture. The spices may include menthol, peppermint, spearmint oil, and various fruit-flavored ingredients, but are not limited thereto. The flavors may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

In addition, the vaporizer 14 may be referred to as a cartomizer or an atomizer, but it is not limited thereto.

The aerosol generating device 1 may further include other components in addition to the battery 11, the controller 12, the heater 13, and the vaporizer 14. For example, the aerosol generating device 1 may include a display configured to output visual information and/or a motor for outputting haptic information. Also, the aerosol generating device 1 may include at least one sensor (e.g., a puff detecting sensor, a temperature detecting sensor, a cigarette insertion detecting sensor, etc.). Also, the aerosol generating device 1 may be formed as a structure where, even when the cigarette 2 is inserted into the aerosol generating device 1, external air may be introduced or internal air may be discharged.

Although not illustrated in FIGS. 1 and 2, the aerosol generating device 1 and an additional cradle may form together a system. For example, the cradle may be used to charge the battery 11 of the aerosol generating device 1. Alternatively, the heater 13 may be heated when the cradle and the aerosol generating device 1 are coupled to each other.

The cigarette 2 may be a general combustive cigarette. For example, the cigarette 2 may be divided into a first portion including an aerosol generating material and a second portion including a filter, etc. Alternatively, the second portion of the cigarette 2 may also include an aerosol generating material. For example, an aerosol generating material made in the form of granules or capsules may be inserted into the second portion.

The entire first portion may be inserted into the aerosol generating device 1, and the second portion may be exposed to the outside. Alternatively, only a portion of the first portion may be inserted into the aerosol generating device 1, or the entire first portion and a portion of the second portion may be inserted into the aerosol generating device 1. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1. For example, the opening and closing and/or a size of the air passage formed in the aerosol generating device 1 may be adjusted by the user. Accordingly, the amount of smoke and a smoking impression may be adjusted by the user. As another example, the external air may flow into the cigarette 2 through at least one hole formed in a surface of the cigarette 2. Hereinafter, an example of the cigarette 2 will be described with reference to FIG. 3.

FIG. 3 illustrates an example of a cigarette shown in FIGS. 1 and 2.

The cigarette 3 of FIG. 3 may correspond to the cigarette 2 of FIGS. 1 and 2.

Referring to FIG. 3, the cigarette 3 may include a tobacco rod 31 and a filter rod 32. The first portion 31 described above with reference to FIGS. 1 and 2 may include the tobacco rod, and the second portion may include the filter rod 32.

According to embodiments, the cigarette 3 may include a front-end plug 33. The front-end plug 33 may be located on a side of the tobacco rod 31, the side opposite from the filter rod 32. The front-end plug 33 may prevent the tobacco rod 31 from being detached outward and prevent a liquefied aerosol from flowing into the aerosol generating device 1 from the tobacco rod 31 during smoking.

The tobacco rod 31 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 31 may include other additives, such as flavors, a wetting agent, and/or organic acid. Also, the tobacco rod 31 may include a flavored liquid, such as menthol or a moisturizer, which may be injected into the tobacco rod 31.

The tobacco rod 31 may be manufactured in various forms. For example, the tobacco rod 31 may be formed as a sheet or a strand. Also, the tobacco rod 31 may be formed as a pipe tobacco, which is formed of tiny bits cut from a tobacco sheet. Also, the tobacco rod 31 may be surrounded by a heat conductive material. For example, the heat-conducting material may be, but is not limited to, a metal foil such as aluminum foil. For example, the heat conductive material surrounding the tobacco rod 31 may uniformly distribute heat transmitted to the tobacco rod 31, and thus, the heat conductivity applied to the tobacco rod may be increased and taste of the tobacco may be improved. Also, the heat conductive material surrounding the tobacco rod 31 may function as a susceptor heated by the induction heater. Here, although not illustrated in the drawings, the tobacco rod 31 may further include an additional susceptor, in addition to the heat conductive material surrounding the tobacco rod 31.

The filter rod 32 may include a first segment and a second segment. The filter rod 32 may include a cellulose acetate filter. Also, the shape of the filter rod 32 are not limited. For example, the filter rod 32 may include a cylinder-type rod or a tube-type rod having a hollow inside. Also, the filter rod 32 may include a recess-type rod. When the filter rod 32 includes a plurality of segments, at least one of the plurality of segments may have a different shape.

Also, the filter rod 32 may include at least one capsule 34. Here, the capsule 34 may generate a flavor or an aerosol. For example, the capsule 34 may have be formed such that a liquid containing a flavoring material is wrapped with a film. For example, the capsule 34 may have a spherical or cylindrical shape, but is not limited thereto.

The length of the front-end plug 33 may be about 7 mm, the length of the tobacco rod 31 may be about 15 mm, the length of the first segment 321 may be about 12 mm, and the length of the second segment 322 may be about 14 mm, however, the length of each component described above is not limited thereto.

The cigarette 3 may be packaged by at least one wrapper 35. The wrapper 35 may have at least one hole through which external air may be introduced or internal air may be discharged. For example, the front-end plug 33 may be packaged by a first wrapper 351, and the tobacco rod 31 may be packaged by a second wrapper 352, and the first segment 321 may be packaged by a third wrapper 353, and the second segment 322 may be packaged by a fourth wrapper 354. Also, the entire cigarette 3 may be packaged by a fifth wrapper 355.

Also, the fifth wrapper 355 may have at least one hole 36. For example, the hole 36 may be formed in an area surrounding the tobacco rod 31, but is not limited thereto. The hole 36 may serve to transfer heat formed by the heater 13 shown in FIG. 1 and FIG. 2 to the inside of the tobacco rod 31.

On the other hand, the cigarette 3 may further include an electromagnetic inductor. The electromagnetic inductor may change the inductance of a substance detector 451 in FIG. 4 described below. The electromagnetic inductor may include a conductor capable of inducing an eddy current and a magnetic material capable of inducing a magnetic flux change. For example, the electromagnetic inductor may include a metallic material, a magnetic ink, a magnetic tape, etc. For example, the electromagnetic inductor may be an aluminum foil. Also, the electromagnetic inductor may include materials that change the inductance of the substance detector 451 without limitation.

In an embodiment, at least one of the first to fifth wrappers 351 to 355 may include an electromagnetic inductor material.

In another embodiment, the electromagnetic inductor may surround at least one wrapper among the first to fifth wrappers 351 to 355 along the circumference of the cigarette 3 while one side surface of the electromagnetic inductor facing the inner surface of the at least one wrapper.

The position at which the electromagnetic inductor is provided within the cigarette 3 may vary.

In an embodiment, the electromagnetic inductor may be provided in a region corresponding to the front-end plug 33. Here, since the cigarette 3 is inserted into the aerosol generating device 1 in a direction in which the front-end plug 33 faces the aerosol generating device 1, the electromagnetic inductor may be inserted into the aerosol generating device 1 as soon as the insertion of the cigarette 3 is started. Therefore, the substance detector 451 may detect that the insertion of the cigarette 3 is started at an early point by detecting the proximity of the electromagnetic inductor.

Also, when the cigarette 3 is separated from the aerosol generating device, the frontend plug 33 is separated from the aerosol generating device 1 at the end, and thus the substance detector 451 may detect that the cigarette 3 is completely separated by detecting separation of the electromagnetic inductor.

In another embodiment, the electromagnetic inductor may be inside the tobacco rod 31 or surround the tobacco rod 31 while being overlapped with the fifth wrapper 355.

In another embodiment, the electromagnetic inductor may be inside the filter rod 32 or surround the filter rod 32 while being overlapped with the fifth wrapper 355.

In another embodiment, the electromagnetic inductor may be provided between segments. Alternatively, the electromagnetic inductor may be provided at the bottom or the top of the cigarette 3.

FIG. 4 is a block diagram of an aerosol generating device according to one or more embodiments.

Referring to FIG. 4, the aerosol generating device 1 according to one or more embodiments may include a controller 410, a battery 420, a first heater 430, a second heater 440, a detector 450, an output unit 460, an input unit 470, and a memory 480.

Also, the detector 450 may include a substance detector 451 that detects an aerosol generating substance, a puff detector 453 that detects a puff of a user, and a temperature detector that detects temperatures of the heaters 430 and 440.

The controller 410 may collectively control the battery 420, the first heater 430, the second heater 440, the detector 450, the output unit 460, the input unit 470, and the memory 480 included in the aerosol generating device 1.

The battery 420 supplies power to the first heater 430 and the second heater 440, and the amount of power supplied to each of the first heater 430 and the second heater 440 may be adjusted by the controller 410.

The first heater 430 may generate a first aerosol by heating a first aerosol generating substance. When a current is applied to the first heater 430, heat is generated by a specific resistance, and, when a first aerosol generating substance contacts (or combined with) the heated first heater 430, aerosol may be generated.

The first heater 430 may be a component corresponding to the heater 13 of FIGS. 1 and 2. Also, the first aerosol generating substance may be the cigarette 2 of FIGS. 1 and 2. The first aerosol generating substance may be a solid substrate including nicotine.

The second heater 440 may generate a second aerosol by heating a second aerosol generating substance. The second heater 440 may be a component corresponding to a heating element provided in the vaporizer 14 of FIGS. 1 and 2. Also, the second aerosol generating substance may be a liquid composition stored in the liquid storage of FIGS. 1 and 2. The second aerosol generating substance may be a liquid substance including an aerosol forming agent.

The second heater 440 may generate a second aerosol by heating the second aerosol generating substance, and the generated second aerosol may pass through the first aerosol generating substance and be delivered to a user together with the first aerosol.

The controller 410 may control power supplied to the first heater 430 and the second heater 440. The controller 410 may adjust power supplied to the first heater 430 and the second heater 440 by controlling the battery 420.

The controller 410 may control power supplied to the first heater 430 and the second heater 440 through a pulse width modulation (PWM). To this end, the controller 410 may include a PWM module.

The controller 410 may determine whether the first aerosol generating substance is inserted and extracted, and, based on a result of the determination, control power supplied to the first heater 430 and the second heater 440, thereby heating the first heater 430 and the second heater 440.

Specifically, the inductance of the substance detector 451 may vary as the first aerosol generating substance is inserted and separated. For example, the substance detector 451 may include at least one inductance to digital converter (LDC). When there are a plurality of LDCs, the plurality of LDCs may detect the state of insertion and separation of the first aerosol generating substance at different positions.

When the first aerosol generating substance is the cigarette 2 of FIGS. 1 and 2, the substance detector 451 may be provided in the cavity 15 to detect the presence of the cigarette 2. Here, the substance detector 451 may also be referred to as a cigarette detector.

The controller 410 may determine whether the first aerosol generating substance is inserted or separated based on an amount of change in the inductance of the substance detector 451. The controller 410 may determine that the first aerosol generating substance is inserted into the cavity 15 when the amount of change in the inductance of the substance detector 451 is equal to or greater than a pre-set upper-limit threshold value. The controller 410 may determine that the first aerosol generating substance is separated from the cavity 15 when the amount of change in the inductance of the substance detector 451 is less than or equal to a pre-set lower-limit threshold value.

When it is determined that the first aerosol generating substance is inserted into the cavity 15, the controller 410 may output a trigger signal for heating the first aerosol generating substance. The trigger signal may be a PWM type signal. The controller 410 may start supplying power to the first heater 430 through the trigger signal. In other words, when it is determined that the first aerosol generating substance is inserted into the cavity 15, the controller 410 may start pre-heating the first heater 430.

Also, after the pre-heating of the first heater 430 is started, the controller 410 may start pre-heating the second heater 440 at a first time point before the pre-heating of the first heater 430 is completed. For example, when a pre-heating time period for the first heater 430 is 30 seconds, the controller 410 may start pre-heating the second heater 440 from 27 seconds, that is, 3 seconds before the completion of the pre-heating of the first heater 430.

The controller 410 may calculate a pre-heating start timing for the second heater 440 based on the pre-heating time of the first heater 430. The controller 410 may start preheating the second heater 440 at a predetermined time point before the pre-heating of the first heater 430 is completed. The reason for the controller 410, as the controller 410 enters a pre-heating period, controlling the second heater 440 to not to be heated simultaneously with the first heater 430 is that, the first heater 430 heats a solid substance like a cigarette while the second heater 440 heats a liquid composition absorbed by a wick, which may reach a target pre-heating temperature more easily.

The controller 410 may control power supplied to the first heater 430 during a pre-set pre-heating time, such that the temperature of the first heater 430 rises to a vaporization temperature at which the first aerosol is generated by a time point at which the pre-heating of the first heater 430 is completed.

Also, the controller 410 may control the power supplied to the second heater 440 for a first time period after the pre-heating of the second heater 440 is started at the first time point, such that the temperature of the second heater 440 exceeds a vaporization temperature at which the second aerosol is generated at a second time point, which is a time point after the first time period from the first time point.

Also, the controller 410 may control power supplied to the second heater 440 during a second time period from the second time point, such that the temperature of the second heater 440 at a time point at which the pre-heating of the second heater 440 is completed becomes a temperature that is lower than, or close to, the vaporization temperature for generating the second aerosol.

The reason for pre-heating the temperature of the second heater 440 to a temperature that is lower than, or close to, the vaporization temperature for generating the second aerosol is to prevent the second aerosol generating substance, which is installed to increase the amount of smoke, from generating the second aerosol regardless of a puff of a user and to quickly heat the second aerosol generating substance in response to a puff of the user.

In addition, the controller 410 may not supply additional power to the second heater 440 during the second time period from the second time point even when a puff of a user is detected. The reason thereof is to prevent coil carbonization due to overheating of the second heater 440.

The controller 410 may control the temperatures of the first heater 430 and the second heater 440 based on a temperature profile stored in the memory 480 during a pre-set smoking time after the pre-heating time.

When the first heater 430 and the second heater 440 are heated, the controller 410 may correct an inductance output value of the substance detector 451 according to an increase in the temperature of the first heater 430 and/or the second heater 440. The controller 410 may decrease the inductance output value of the substance detector 451 in response to an increase in the temperature of any one of the first heater 430 and the second heater 440.

The controller 410 may determine whether the first aerosol generating substance is separated based on the corrected inductance output value.

When it is determined that the first aerosol generating substance is separated from the cavity 15 while the first heater 430 and the second heater 440 are being heated, the controller 410 may not immediately stop heating of the first heater 430 and the second heater 440 and continuously calculate the amount of change in the inductance of the substance detector 451. The reason for the continuous calculation is to detect a case in which the first aerosol generating substance is separated from the cavity 15 against the intention of a user.

The controller 410 may determine whether the first aerosol generating substance is re-inserted based on the amount of change in the inductance of the substance detector 451 during a pre-set separation time. When the first aerosol generating substance is reinserted within the pre-set separation time, the controller 410 may continuously heat the first heater 430 and the second heater 440. When the first aerosol generating substance is not re-inserted within the pre-set separation time, the controller 410 may stop heating the first heater 430 and the second heater 440. Therefore, the aerosol generating device 1 according to one or more embodiments may reduce unnecessary power consumption and prevent overheating of the aerosol generating device 1.

The puff detector 453 may detect a puff of a user. To this end, the puff detector 453 may include at least one pressure sensor.

When the pressure inside the aerosol generating device 1 is less than or equal to a reference pressure, the puff detector 453 may transmit a puff detection signal to the controller 410. The controller 410 may heat the second heater 440 in response to receiving the puff detection signal.

The temperature detector 455 may be provided in each of the first heater 430 and the second heater 440 and detect the temperatures of the first heater 430 and the second heater 440. To this end, the temperature detector 455 may include a temperature sensor. For example, the temperature detector 455 may detect changes in thermal resistances of the first heater 430 and the second heater 440.

The temperature detector 455 may transmit a temperature detection signal to the controller 410. The controller 410 may calculate the temperatures of the first heater 430 and the second heater 440 based on the temperature detection signal. The controller 410 may calculate heating time points, heating periods, and power to be supplied to the first heater 430 and the second heater 440 based on the temperatures of the first heater 430 and the second heater 440.

The output unit 460 may output visual information and/or tactile information related to the aerosol generating device 1.

The input unit 470 may receive a user input. For example, the input unit 470 may be provided in the form of a press-push button.

The input unit 470 may receive ON/OFF commands for the aerosol generating device 1. When an operation command for the aerosol generating device 1 is received, the input unit 470 may transmit a control signal corresponding to the operation command to the controller 410.

The memory 480 may store information for the operation of the aerosol generating device 1. For example, the memory 480 may store a temperature profile for the controller 410 to appropriately control power supply to the first heater 430 and the second heater 440 to provide various flavors to a user of the aerosol generating device 1. The temperature profile may include information, such as pre-heating time points, pre-heating periods, and pre-heating temperatures for the first heater 430 and the second heater 440.

FIG. 5 is a flowchart for describing a method of operating a heater according to whether an aerosol generating substance is inserted and separated, according to one or more embodiments.

Referring to FIG. 5, in operation S510, the controller 410 may determine whether a first aerosol generating substance is inserted into the cavity 15 based on the amount of change in the inductance of the substance detector 451.

The controller 410 may determine whether the first aerosol generating substance is inserted into the cavity 15 based on an inductance output value output by the substance detector 451. The controller 410 may determine that the first aerosol generating substance is inserted into the cavity 15 based on the amount of change in the inductance of the substance detector 451 being equal to or greater than a pre-set upper-limit threshold value.

In operation S520, when the first aerosol generating substance is inserted into the cavity 15, the controller 410 may control one or more heaters to heat the first aerosol generating substance.

The controller 410 may automatically heat the first heater 430 when the first aerosol generating substance is inserted into the cavity 15. In other words, the controller 410 may heat the first heater 430 without a user input when the first aerosol generating substance is inserted into the cavity IS.

In operation S530, the controller 410 may detect whether the first aerosol generating substance is separated from the cavity 15 based on an amount of change in the inductance of the substance detector 451 while the first aerosol generating substance is being heated.

The inductance output value of the substance detector 451 may be increased according to an increase in the temperature of the first heater 430 and/or the second heater 440. Therefore, in order to accurately detect separation of the first aerosol generating substance, it is necessary to correct the inductance output value of the substance detector 451.

The controller 410 may decrease the inductance output value of the substance detector 451 in response to an increase in the temperature of any one of the first heater 430 and the second heater 440.

The controller 410 may determine whether the first aerosol generating substance is separated based on the corrected inductance output value. The controller 410 may determine that the first aerosol generating substance is separated from the cavity 15 based the amount of change in the corrected inductance of the substance detector 451 being less than or equal to a pre-set lower-limit threshold value.

In operation S540, when the first aerosol generating substance is separated from the cavity 15, the controller 410 may stop heating the first aerosol generating substance based on an amount of change in the inductance of the substance detector 451 during a pre-set separation time.

The controller 410 may determine whether the first aerosol generating substance is re-inserted based on the amount of change in the inductance of the substance detector 451 during the pre-set separation time. For example, the pre-set separation time may be set to 5 seconds, but the pre-set separation time is not limited thereto.

The controller 410 may block power supply to the first heater 430 and the second heater 440 when the amount of change in the inductance of the substance detector 451 during the pre-set separation time is less than the pre-set upper-limit threshold value. In other words, when the controller 410 fails to detect re-insertion of the first aerosol generating substance during the pre-set separation time after the first aerosol generating substance is separated, the controller 410 may stop heating the first heater 430 and the second heater 440 without a user input.

When the amount of change in the inductance of the substance detector 451 during the pre-set separation time is equal to or greater than the pre-set upper-limit threshold value, the controller 410 may determine that the first aerosol generating substance is inserted and continue supplying power to the first heater 430 and the second heater 440.

FIG. 6 is a flowchart for describing a method of detecting an insertion of an aerosol generating substance and corresponding operations of a heater and an output unit when an aerosol generating substance is inserted, and FIG. 7 is a graph further describing FIG. 6.

Referring to FIG. 6, in operation S610, the controller 410 may activate the substance detector 451 that detects the presence of a first aerosol generating substance.

The controller 410 may block power supplied to the first heater 430 and the second heater 440 and supply power to the substance detector 451, in a standby mode. The standby mode may refer to a mode in which only a minimum amount of power is consumed to detect insertion of the first aerosol generating substance. The standby mode refers to any mode in which power supplied to remaining components other than components for detecting insertion of the first aerosol generating substance (e.g., a substance detector, etc.) is blocked before the first aerosol generating substance is inserted, and the standby mode according to one or more embodiments is not limited thereto. For example, the standby mode may be similar to a mode like a power saving mode, a sleep mode, etc.

In operation S620, the controller 410 may periodically collect inductance output values of the substance detector 451 after the substance detector 451 is activated.

A period for collecting inductance output values may be appropriately set based on power consumption, an amount of change in inductance, etc. For example, the controller 410 may collect inductance output values of the substance detector 451 at the interval of 0.5 ms, but one or more embodiments are not limited thereto.

According to an embodiment, the controller 410 may collect inductance output values of the substance detector 451 in real time.

In operation S630, the controller 410 may calculate an amount of change in inductance based on inductance output values.

Specifically, since the first aerosol generating substance includes an electromagnetic inductor, when the first aerosol generating substance is inserted into the cavity 15, the inductance of a coil included in the substance detector 451 may be increased.

FIG. 7 is a diagram showing an amount of change in inductance over time. In FIG. 7, the x-axis represents time, the y-axis represents inductance output values of the substance detector 451, and a first graph 710 represents a change in inductance due to an insertion of the first aerosol generating substance.

As shown in FIG. 7, it may be seen that, when the first aerosol generating substance is inserted into the cavity 15, the inductance output value increases. The substance detector 451 may output an inductance value to the controller 410 as a detection signal. The controller 410 may calculate an inductance increase ΔL1.

Referring back to FIG. 6, in operation S640, the controller 410 may compare an amount of change in inductance with an upper-limit threshold value.

The upper-limit threshold value may be set in consideration of self-inductance of the substance detector 451 and a mutual inductance between the substance detector 451 and the first aerosol generating substance. For example, the upper-limit threshold value may be, but is not limited to, +0.32 mH.

In operation S650, the controller 410 may determine that the first aerosol generating substance is inserted into the cavity 15 when the amount of change in inductance is equal to or greater than the upper-limit threshold value.

For example, in FIG. 7, the controller 410 may determine that the first aerosol generating substance is inserted into the cavity 15 since the inductance increase ΔL1 is equal to or greater than an upper-limit threshold value th1.

In another example, when the inductance increase ΔL1 is less than the upper-limit threshold value (th1), the controller 410 may determine that the first aerosol generating substance is not inserted into the cavity 15 and maintain the standby mode. In other words, the controller 410 may block power supplied to the first heater 430 and the second heater 440, but continue to supply power to the substance detector 451. As such, the controller 410 may periodically collect inductance output values of the substance detector 451 while power is being supplied to the substance detector 451.

In operation S660, when it is determined that the first aerosol generating substance is inserted into the cavity 15, the controller 410 may output a trigger signal for heating the first aerosol generating substance.

In an embodiment, the trigger signal may be a signal modulated through a PWM method. The controller 410 may output the trigger signal to the battery 420, and the battery 420 may supply power to the first heater 430 based on the trigger signal. In other words, pre-heating of the first heater 430 may be initiated by the trigger signal. Since the first heater 430 is automatically pre-heated in response to the insertion of the first aerosol generating substance even without a user input, thereby improving the user convenience.

Further, pre-heating of the second heater 440 may not be heated simultaneously as the first aerosol generating substance is inserted an detected. The reason for this is that the first heater 430 heats a solid substance, but the second heater 440 heats a liquid composition absorbed by a wick, which may reach a target pre-heating temperature more easily.

The controller 410 may calculate a pre-heating start time for the second heater 440 based on the pre-heating time for the First heater 430 after the pre-heating of the first heater 430 is started. For example, when a pre-heating time for the first heater 430 is 30 seconds, the controller 410 may start pre-heating the second heater 440 from 27 seconds, that is, 3 seconds before the completion of the pre-heating of the first heater 430. The method of pre-heating the first heater 430 and the second heater 440 will be described below in more detail with reference to FIG. 8.

In operation S670, the output unit 460 may visually or audibly output an insertion state of the aerosol generating substance.

To this end, the output unit 460 may further include a display and a speaker. The output unit 460 may display a screen image of detection of the first aerosol generating substance through the display and the speaker and may display whether entered a preheating mode.

FIG. 8 is a flowchart of a method of heating a heater according to a pre-heating period and a smoking period.

Referring to FIG. 8, in operation S810, the controller 410 may pre-heat the first heater 430 during a pre-set pre-heating time.

Specifically, when it is determined that a first aerosol generating substance is inserted into a cavity, the controller 410 may output a trigger signal to the battery 420 for heating the first aerosol generating substance. The battery 420 may supply power to the first heater 430 based on the trigger signal. In other words, pre-heating of the first heater 430 may be initiated by the trigger signal.

The controller 410 may heat the first heater 430 during the pre-set pre-heating time. For example, the pre-heating time may be, but is not limited to, 30 seconds.

The controller 410 may pre-heat the first heater 430 during a pre-set pre-heating time, thereby increasing the temperature of the first heater 430 to a vaporization temperature at which the first aerosol is generated. Therefore, the aerosol generating device according to one or more embodiments may provide a user with a rich flavor as soon as a smoking period is started.

The controller 410 may calculate a pre-heating start timing for the second heater 440 based on the pre-heating time of the first heater 430.

After the pre-heating of the first heater 430 is started, the controller 410 may start pre-heating the second heater 440 at a first time point before the pre-heating of the first heater 430 is completed. For example, when a pre-heating time for the first heater 430 is 30 seconds, the controller 410 may start pre-heating the second heater 440 from 27 seconds, that is, 3 seconds before the completion of the pre-heating of the first heater 430.

The reason that the controller 410 does not control the second heater 440 to heat simultaneously as the controller 410 enters a pre-heating period is that, the first heater 430 heats a solid substance like a cigarette, but the second heater 440 heats a liquid composition absorbed by a wick, which may reach a target pre-heating temperature more easily.

The controller 410 may control the power supplied to the second heater 440 for a first time period after the pre-heating of the second heater 440 is started at the first time point, such that the temperature of the second heater 440 exceeds a vaporization temperature at which the second aerosol is generated at a second time point, which is a time point after the first time period from the first time point.

Also, the controller 410 may control power supplied to the second heater 440 during a second time period from the second time point, such that the temperature of the second heater 440 at a time point at which the pre-heating of the second heater 440 is completed becomes a temperature that is lower than, and close to, the vaporization temperature for generating the second aerosol.

The reason for pre-heating the temperature of the second heater 440 to a temperature that is lower than, and close to, the vaporization temperature for generating the second aerosol is to prevent the second aerosol generating substance, which is installed to increase the amount of smoke, from generating the second aerosol regardless of a puff of a user and to quickly heat the second aerosol generating substance in response to a puff of the user.

In addition, the controller 410 may not supply additional power to the second heater 440 during the second time period from the second time point even when a puff of a user is detected. The reason thereof is to prevent coil carbonization due to overheating of the second heater 440.

In operation S820, the controller 410 may heat the first heater 430 during a pre-set smoking time after the pre-heating time. For example, the smoking time may be, but is not limited to, 4 minutes.

During the smoking period, the controller 410 may maintain the temperature of the first heater 430 above the temperature at which the first aerosol is generated and may heat the second heater 440 in response to a puff of a user.

Specifically, the controller 410 may control the temperature of the first heater 430 to maintain a first pre-heating temperature during the smoking period. For example, the controller 410 may control the temperature of the first heater 430 through a proportional integral difference (PID) control method, but one or more embodiments are not limited thereto.

When the puff detector 453 detects a puff of a user while the temperature of the second heater 440 is being maintained at a temperature at which the second aerosol is not generated, the controller 410 may increase the temperature of the second heater 440.

Also, when the controller 410 has increased the temperature of the second heater 440, the control unit 410 may not re-heat the second heater 440 even when the puff detector 453 detects successive puffs of the user during a pre-set rest period. For example, the pre-set rest period may be 1 second. The reason thereof is to prevent coil carbonization due to overheating of the second heater 440.

As described above, in one or more embodiments, by separately providing a preheating period before a smoking period, a liquid viscosity immediately before the smoking period may be reduced to a viscosity in which vaporization may easily occur. Therefore, an amount of smoke at the beginning of the smoking period may be significantly increased by increasing the transfer speed of a liquid composition to a wick. Also, user satisfaction may be improved due to the increase in the amount of smoke at the beginning of the smoking period.

In addition, when the temperatures of the first heater 430 and the second heater 440 increase, the inductance output value of the substance detector 451 may increase. Therefore, an error may occur when the presence of the first aerosol generating substance is determined based on the same criterion without the correction of the inductance output value.

FIG. 9 is a diagram showing a change in an inductance output value according to an increase in the temperature of a heater.

As shown in FIG. 9, the inductance output value of the substance detector 451 may increase as the temperature of the first heater 430 and/or the second heater 440 increases.

Specifically, FIG. 9 shows an example of a change in an inductance output value according to a temperature change of the first heater 430. In FIG. 9, the x-axis represents the temperature of the first heater 430, and the y-axis represents the inductance output value of the substance detector 451. Also, a second graph 910 shows the change in an actual inductance output values according to the temperature increase of the first heater 430, and a third graph 920 shows an ideal inductance output value according to the temperature increase of the first heater 430.

In FIG. 9, although the inductance output value needs to be constant regardless of the temperature increase of the first heater 430 as shown in the third graph 920, it may be seen that the actual inductance output value increases as the temperature of the first heater 430 increases as shown in the second graph 910. Therefore, to accurately detect separation of the first aerosol generating substance, it is necessary to correct the second graph 910 as in the third graph 920.

In addition, FIG. 9 only shows that the second graph 910 linearly varies according to the temperature of the first heater 430. However, according to the embodiments, the second graph 910 may vary non-linearly according to the temperature change of the first heater 430.

FIG. 10 is a flowchart for describing a method of detecting separation of an aerosol generating substance and a method of operating a heater and an output unit when an aerosol generating substance is separated, and FIG. 11 is a graph further describing FIG. 10.

Referring to FIG. 10, in operation S1010, the controller 410 may periodically collect inductance output values using the substance detector 451.

A period for collecting inductance output values may be appropriately set based on power consumption, an amount of change in inductance, etc. For example, the controller 410 may collect inductance output values of the substance detector 451 at the interval of 0.5 ms, but one or more embodiments are not limited thereto.

In operation S1020, the controller 410 may correct the inductance output value of the substance detector 451.

The controller 410 may decrease the inductance output value of the substance detector 451 in response to an increase in the temperature of the first heater 430.

That is, the controller 410 may derive a first relational expression between the temperature of the first heater 430 and the inductance output value based on the inductance output values collected in operation S1010. For example, the controller 410 may estimate the first relational expression between the temperature of the first heater 430 and an inductance output value by using a method of least squares. The first relational expression between the temperature of the first heater 430 and the inductance output value may correspond to the second graph 910 of FIG. 9. In FIG. 9, the controller 410 may derive the second graph 910 based on three collected samples p1, p2, and p3.

The memory 480 may store an ideal inductance output value according to the temperature increase of the first heater 430. The memory 480 may store a second relational expression between the temperature of the first heater 430 and the ideal inductance output value. The second relational expression between the temperature of the first heater 430 and the ideal inductance output value may correspond to the third graph 920 of FIG. 9.

The controller 410 may calculate a corrected value of a corresponding temperature based on the first relational expression and the second relational expression and subtract the corrected value from an actually measured inductance output value. Therefore, the second graph 910 of FIG. 9 may be corrected to be identical to the third graph 920.

In operation S1030, the controller 410 may calculate an amount of change in inductance based on the corrected inductance output value.

Specifically, since the first aerosol generating substance includes an electromagnetic inductor, when the first aerosol generating substance is separated from the cavity 15, the inductance of a coil included in the substance detector 451 may be decreased.

FIG. 11 is a diagram showing an amount of change in inductance over time. In FIG. 11, the x-axis represents time, the y-axis represents inductance output values of the substance detector 451, and a fourth graph 1120 represents a change in inductance due to a separation of the first aerosol generating substance from the aerosol generating device.

As shown in FIG. 11, it may be seen that, when the first aerosol generating substance is separated from the cavity 15, the inductance output value decreases. The substance detector 451 may output an inductance output value to the controller 410 as a detection signal. The controller 410 may calculate an inductance decrease $\Delta L2$.

Referring back to FIG. 10, in operation S1040, the controller 410 may compare an amount of change in inductance with a lower-limit threshold value.

The lower-limit threshold value may be set in consideration of self-inductance of the substance detector 451 and a mutual inductance between the substance detector 451 and the first aerosol generating substance. For example, the lower-limit threshold value may be, but is not limited to, −0.32 mH.

In operation S1050, the controller 410 may determine that the first aerosol generating substance is separated from the cavity 15 when the amount of change in the inductance of the substance detector 451 is less than or equal to the lower-limit threshold value.

For example, in FIG. 11, the controller 410 may determine that the first aerosol generating substance is separated from the cavity 15 since the inductance decrease $\Delta L2$ is less than or equal to a lower-limit threshold value th2.

In another example, when the inductance decrease $\Delta L2$ is greater than the lower-limit threshold value, the controller 410 may determine that the first aerosol generating substance is still inserted into the cavity 15, heat the first heater 430 and the second heater 440, and calculate a change in the inductance based on a corrected inductance output value.

The absolute value of the lower-limit threshold value th2 of FIG. 11 may be the same as the absolute value of the upper-limit threshold value th1 of FIG. 7. When the absolute value of the lower-limit threshold value th2 is set to be equal to the absolute value of the upper-limit threshold value th1, insertion and separation of the first aerosol generating substance may be determined more accurately.

In operation S1060, when it is determined that the first aerosol generating substance is separated from the cavity 15, the controller 410 may determine whether to stop heating the first aerosol generating substance based on the amount of change in inductance.

The method of determining whether to stop heating the first heater 430 and the second heater 440 will be described below in more detail with reference to FIG. 12.

In operation S1070, the output unit 460 may visually or audibly output a separation state of the aerosol generating substance.

To this end, the output unit 460 may further include a display and a speaker. The output unit 460 may display a screen image of separation of the first aerosol generating substance through the display and the speaker and may display whether entered a standby mode.

FIG. 12 is a flowchart of a method of stopping heating of a heater when an aerosol generating substance is separated.

Referring to FIG. 12, in operation S1210, the controller 410 may periodically collect inductance output values of the substance detector 451 during a pre-set separation time. For example, the pre-set separation time may be 5 seconds, but is not limited thereto.

In operation S1220, the controller 410 may calculate an amount of change in inductance based on inductance output values.

As shown in FIGS. 10 and 11, the controller 410 may use a corrected inductance output value to more accurately determine the separation of the first aerosol generating substance. In other words, the controller 410 may calculate an amount of change in inductance based on the corrected inductance output value.

In operation S1230, the controller 410 may compare an amount of change in inductance with an upper-limit threshold value.

The upper-limit threshold value may be set in consideration of self-inductance of the substance detector 451 and a mutual inductance between the substance detector 451 and the first aerosol generating substance. For example, the upper-limit threshold value may be, but is not limited to, +0.32 mH.

In operation S1240, the controller 410 may stop heating the first aerosol generating substance when the amount of change in inductance is less than the upper-limit threshold value. The upper-limit threshold value of FIG. 12 may be the same as the upper-limit threshold value of FIGS. 6 and 7.

In operation S1250, the controller 410 may alternatively determine that the first aerosol generating substance is re-inserted when the amount of change in inductance is equal to or greater than the upper-limit threshold value.

In operation S1260, when it is determined that the first aerosol generating substance is re-inserted, the controller 410 may maintain heating of the first aerosol generating substance.

As described above, even when it is determined first that an aerosol generating substance is separated, the aerosol generating device 1 according to one or more embodiments does not immediately stop heating a heater and stops heating the heater after a second determination of separation of the aerosol generating substance. In other words, when an aerosol generating substance is unintentionally separated due to a mistake of a user (e.g., dropping the aerosol generating device 1, the aerosol generating substance being stuck to lips of the user, etc.), the aerosol generating device 1 according to one or more embodiments does not stop heating a heater and stops heating the heater based on detection of re-insertion of the aerosol generating substance.

Therefore, the aerosol generating device 1 according to one or more embodiments may not only prevent heating of a heater from being stopped against an intention of a user, but also provide a rich flavor to the user by maintaining the temperature of the heater constantly during a smoking period.

At least one of the components, elements, modules or units (collectively "components" in this paragraph) represented by a block in the drawings, such as the controller 410 in FIG. 4, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The embodiments of the inventive concept may be written as computer programs and can be implemented in computers that execute the programs using a non-transitory computer readable recording medium. In addition, the structure of the data used in the above-described method may be recorded on a computer-readable recording medium through various means. Examples of the computer readable recording medium include magnetic storage media (e.g., ROM, RAM, USB drives, floppy disks, hard disks, etc.), optical recording media (e.g., CD-ROMs, or DVDs), etc.

Those of ordinary skill in the art may understand that various changes in form and details can be made therein without departing from the scope of the embodiments of the inventive concept described above. The disclosed methods should be considered in a descriptive sense only, and not as limiting the one or more embodiments of the disclosure. In addition, the scope of the present disclosure is defined by the appended claims, and any modifications, substitutions, improvements and any equivalents thereof should be construed as falling within the scope of the present disclosure.

The invention claimed is:

1. An operation method of an aerosol generating device, the method comprising:

detecting whether an aerosol generating substance is inserted into a cavity based on an amount of change in inductance;

heating the aerosol generating substance based on the aerosol generating substance being inserted into the cavity;

detecting whether the aerosol generating substance is separated from the cavity based on the amount of change in the inductance while the aerosol generating substance is being heated; and, based on determining that the aerosol generating substance is separated from the cavity, stopping the heating of the aerosol generating substance based on the amount of change in the inductance during a pre-set separation time.

2. The method of claim 1, wherein the detecting of whether the aerosol generating substance is inserted into the cavity comprises:

activating a substance detector configured to detect a presence of the aerosol generating substance;

periodically collecting inductance output values of the substance detector after the substance detector is activated;

calculating the amount of change in the inductance based on the inductance output values; and determining that the aerosol generating substance is inserted into the cavity based on the amount of change in the inductance being equal to or greater than a pre-set upper-limit threshold value.

3. The method of claim 2, wherein the detecting of whether the aerosol generating substance is inserted into the cavity further comprises:

outputting a trigger signal for heating the aerosol generating substance based on determining that the aerosol generating substance is inserted into the cavity.

4. The method of claim 1, wherein the heating of the aerosol generating substance comprises:

pre-heating a heater for heating the aerosol generating substance during a pre-set pre-heating time; and heating the heater during a pre-set smoking time after the pre-set pre-heating time.

5. The method of claim 4, wherein the pre-heating of the heater comprises:

initiating pre-heating of the heater based on a trigger signal generated by an insertion of the aerosol generating substance; and increasing a temperature of the heater to a vaporization temperature at which an aerosol is generated.

6. The method of claim 1, wherein the detecting of whether the aerosol generating substance is separated from the cavity comprises:

correcting an inductance output value of a substance detector configured to detect a presence of the aerosol generating substance;

calculating the amount of change in the inductance based on a corrected inductance output value; and determining that the aerosol generating substance is separated from the cavity based on the amount of change in the inductance being less than or equal to a pre-set lower-limit threshold value.

7. The method of claim 6, wherein the correcting of the inductance output value comprises:

decreasing the inductance output value of the substance detector in response to an increase in a temperature of a heater configured to heat the aerosol generating substance.

8. The method of claim 1, wherein the stopping of the heating of the aerosol generating substance comprises:

periodically collecting inductance output values of the substance detector during the pre-set separation time;

calculating the amount of change in the inductance based on the inductance output values; and, stopping heating of the aerosol generating substance based on the amount of change in the inductance being less than a pre-set upper-limit threshold value.

9. An aerosol generating device comprising:

a cavity configured to receive an aerosol generating substance;

a heater configured to heat the aerosol generating substance in the cavity;

a substance detector configured to measure an inductance that varies according to an insertion and a separation of the aerosol generating substance;

a battery configured to supply power to the heater and the substance detector; and a controller configured to determine the insertion and the separation of the aerosol generating substance based on an amount of change in the inductance, and control the heater to heat the aerosol generating substance based on a result of the determination.

10. The aerosol generating device of claim 9, wherein the controller is further configured to:

activate the substance detector while the power is not supplied to the heater, periodically collect inductance output values of the substance detector, calculate the amount of change in the inductance based on the inductance output values, and determine that the aerosol generating substance is inserted into the cavity based on the amount of change in the inductance being equal to or greater than a pre-set upper-limit threshold value.

11. The aerosol generating device of claim 9, wherein the controller is further configured to output a trigger signal for heating the aerosol generating substance based on determining that the aerosol generating substance is inserted into the cavity.

12. The aerosol generating device of claim 11, wherein a pre-heating of the heater is initiated by the trigger signal, and wherein the controller is further configured to increase a temperature of the heater to a vaporization temperature at which an aerosol is generated, by pre-heating the heater during a pre-set pre-heating time.

13. The aerosol generating device of claim 9, wherein the controller is further configured to:

correct the inductance output value of the substance detector while the heater is being heated, calculate the amount of change in the inductance based on an corrected inductance output value, and determine that the aerosol generating substance is separated from the cavity based on the amount of change in the inductance being less than or equal to a pre-set lower-limit threshold value.

14. The aerosol generating device of claim 13, wherein the controller is further configured to correct the inductance output value by decreasing the inductance output value of the substance detector in response to an increase in a temperature of the heater.

15. The aerosol generating device of claim 9, wherein the controller is further configured to:

periodically collect inductance output values of the substance detector during a pre-set separation time based on determining that the aerosol generating substance is separated from the cavity, calculate the amount of change in the inductance based on the inductance output values, and, stop heating of the aerosol generating substance based on the amount of change in the inductance being less than a pre-set upper-limit threshold value.

* * * * *